United States Patent [19]

Iannicelli

[11] 4,424,124

[45] Jan. 3, 1984

[54] METHOD AND MAGNETIC SEPARATOR FOR REMOVING WEAKLY MAGNETIC PARTICLES FROM SLURRIES OF MINUTE MINERAL PARTICLES

[75] Inventor: Joseph Iannicelli, Brunswick, Ga.

[73] Assignee: J. M. Huber Corporation, Locust, N.J.

[21] Appl. No.: 101,393

[22] Filed: Dec. 7, 1979

Related U.S. Application Data

[63] Continuation of Ser. No. 950,468, Oct. 11, 1978, abandoned, which is a continuation of Ser. No. 712,844, Aug. 9, 1976, abandoned, which is a continuation of Ser. No. 574,972, May 6, 1975, abandoned, which is a continuation of Ser. No. 493,820, Aug. 1, 1974, abandoned, which is a continuation of Ser. No. 309,839, Nov. 27, 1972, abandoned, which is a continuation-in-part of Ser. No. 19,169, Mar. 13, 1970, abandoned.

[51] Int. Cl.[3] ..... B03C 1/00

[52] U.S. Cl. ..... 209/214

[58] Field of Search ..... 209/8, 214, 39, 223 R, 209/232; 210/222, 223

[56] References Cited

U.S. PATENT DOCUMENTS

| | | | |
|---|---|---|---|
| 2,074,085 | 3/1937 | Frantz | 209/232 X |
| 2,329,893 | 9/1943 | Girard | 209/232 X |
| 2,407,539 | 9/1946 | Daniels | 210/143 X |
| 2,490,635 | 12/1949 | Kison | 210/223 |
| 2,784,843 | 3/1957 | Braunlick | 210/223 X |
| 2,786,047 | 3/1957 | Jones et al. | 209/223 X |
| 3,289,836 | 12/1966 | Weston | 209/227 X |
| 3,346,116 | 10/1967 | Jones | 210/222 |
| 3,471,011 | 10/1969 | Iannicelli | 209/214 |
| 3,567,026 | 3/1971 | Kolm | 210/222 |
| 3,627,678 | 12/1971 | Marston | 210/222 |

FOREIGN PATENT DOCUMENTS

| | | | |
|---|---|---|---|
| 602033 | 8/1934 | Fed. Rep. of Germany | 209/232 |
| 1139599 | 11/1962 | Fed. Rep. of Germany | 210/222 |

*Primary Examiner*—Ralph J. Hill

*Attorney, Agent, or Firm*—Robert L. Price; William F. Hyer; Harold H. Flanders

[57] ABSTRACT

A method and a magnetic separator are disclosed particularly for the removal of particles of low magnetic susceptibility, present usually as impurities and often largely of submicron sizes, from aqueous slurries of clay or other minute mineral particles. A high intensity magnetic field is established between vertically spaced pole members in the general direction of flow of the slurry through a canister disposed between confronting surfaces of the pole members, the canister being packed with multitudinous elongate ferromagnetic elements which present surface irregularities with each contacting, yet also spaced from others, so as to constitute a flux conductive matrix that diverts the slurry flow into diverse courses and concentrates the flux at myriad points therein. With the magnetic field being applied, the slurry flow is continued until the collecting of weakly magnetic particles onto the matrix elements has diminished substantially, whereupon residual slurry may be rinsed from the canister by a gentle flow of water. Then the magnetizing of the matrix is discontinued and water is forced through the matrix to flush collected particles out of the canister.

3 Claims, 4 Drawing Figures

METHOD AND MAGNETIC SEPARATOR FOR REMOVING WEAKLY MAGNETIC PARTICLES FROM SLURRIES OF MINUTE MINERAL PARTICLES

This is a continuation, of application Ser.No. 950,468, filed Oct. 11, 1978, now abandoned which is a continuation of application Ser. No. 712,844, filed Aug. 9, 1976, now abandoned, which was a continuation of application Ser. No. 574,972, filed May 6, 1975, now abondoned; which was a continuation of application Ser. No. 493,820, filed Aug. 1, 1974, now abandoned; which was a continuation of application Ser. No. 309,839, filed Nov. 27, 1972, now abandoned; which was a continuation-in-part of Ser. No. 19,169, filed Mar. 13, 1970, now abandoned.

This invention relates generally to the technology of magnetic separation and more specifically to a method and apparatus for removing magnetically more susceptible minute particles, often present in minor concentrations as coloring impurities, from aqueous slurries of minute mineral particles such as are obtained by dispersing clay, e.g., a crude kaolin clay, in water.

The iron content of commercial deposits of kaolin clay is generally on the order of from approximately 0.2% to 2%. Even recent publications indicate a continuing dispute as to whether the iron contaminants are in a discrete form or in a combined form within a kaolin lattice structure. While the form of this iron in clay has not been definitely established, recent evidence indicates that a portion is concentrated in or associated with non-kaolin contaminants such as titanium oxides, etc. Whatever its form, iron contamination reduces brightness in clay and the degree of discoloration of the clay generally increases with the amount of iron present.

Numerous attempts to remove iron contaminants from kaolin by magnetic treatments have not been notably successful in the past. Wet magnetic separators of the prior art, such for example as described in U.S. Pat. No. 2,074,085, in general, were able to remove only a small proportion of the iron present in or on kaolin. A wet magnetic separator such as disclosed in U.S. Pat. No. 3,346,116 providing an increased field strength increased interest in the potential of magnetic separation.

U.S. Pat. No. 3,471,011 disclosed as conditions for magnetic beneficiation of kaolin clay that a slurry of the clay in water be subjected to a high intensity magnetic field of at least 8,500 gauss and be retained in this field for from 30 seconds to 8 minutes in order to separate particles of low magnetic susceptibility from the slurry.

Magnetic separation utilizes the forces of a magnetic field gradient to cause differential movements of mineral grains through the field. Differences in the magnetic permeability of minerals form the basis for separation, but separation is also influenced by particle size and mass of the mineral grains, by random collisions, by the characteristics of the medium, and by the mechanical and electrical characteristics of the separator.

As noted above, the exact form of the iron and titanium oxide contaminants associated with kaolin is not entirely understood. However, it is clear that the iron contaminants are often associated with or stained on particles of minerals such as titanium dioxides contained in kaolin. These contaminants are in an extremely fine form, often of submicron size, and have a degrading effect on the whiteness and brightness of kaolin. By previous views at least some of these contaminants were considered to be non-magnetic. For example, see Taggart, A. F.; *Handbook of Mineral Dressing,* p. 13-02 (1960), which shows on a scale of 100.00, taking iron as a standard, that the relative attractability of $TiO_2$ is 0.37.

GENERAL DESCRIPTION OF THE INVENTION

It is an object of the present invention to provide a method and apparatus enabling efficient magnetic extraction of low susceptibility components present, usually at low concentrations, in slurries of very fine mineral particles, such as in aqueous clay slurries.

A further object of the invention to provide for such a magnetic separation method and apparatus a flow system which enables efficient treatment of slurries in high intensity magnetic fields, with programmed flow of feed to the separator and of products, residual slurry, and by-products from the separator.

In accordance with the present invention, a container adapted to have the slurry passed through it in generally axial, or end-to-end direction, is filled with magnetizable elements constituting a flux conductive matrix which serves both for diverting the slurry flow into multitudinous courses and for concentrating magnetic flux at myriad locations therein so as to collect susceptible particles from the slurry; and this container is disposed endwise, or axially, between confronting surfaces of ferromagnetic pole members between which a magnetic field having a high intersity is produced throughout the matrix in the general direction of the slurry flow through the container. Preferably, the matrix elements are packed in a generally cylindrical canister and the canister is oriented between the pole members with its axis vertical, its ends being adjacent to and covered by the pole members and the flow of slurry through the canister being in the same generally vertical direction as the high intensity magnetic field.

The pole members according to one embodiment of the invention are the poles of a high intensity electromagnet oriented vertically, one above the other, and connected together by a flux conductive frame, and provided with even confronting surfaces spaced apart so as to cover the ends of the container. The matrix is subjected to the magnetic field by energization of the magnet while the container is in working position in the gap between the faces of the pole members. The orientation of the apparatus, of course, is not necessarily vertical but may be horizontal or at some other desired inclination.

The collecting matrix provided in the container is composed of multitudinous elongate ferromagnetic elements of strip or ribbon-like form which present surface irregularities and are packed in the container space, with each contacting yet also spaced from others, so that as the generally axial, or end to end, flow of the slurry proceeds through the container the slurry is diverted into multitudinous diverse courses of minute width, as by being caused to flow tortuously to and fro in the container between and among the matrix forming elements, while the flux of the magnetic field being applied is concentrated by angles and other surface irregularities of the matrix elements at myriad points in those courses. The matrix desirably diverts the slurry flow into courses having widths as small as practicable, e.g., less than 0.1 inch, so as to minimize the distance of travel required for weakly magnetic particles in the flurry to reach magnetized collecting sites on the matrix elements.

An effective collecting matrix of this nature may be provided, for example, by filling the container with arrays of corrugated and non-corrugated stainless steel strips, ribbons or wires, of forms such as shown in U.S. Pat. No. 2,074,085, or by packing it with finer filamentary material, such as a fine screen of woven steel wire, ribbons or a steel wool, which occupies a relatively small portion of the volumetric space of the container yet provides a vast number of very narrow courses or passageways for the flow of the slurry and provides in contact with the slurry a vast number of sites for locally concentrating the magnetic field and thereby fostering effective collection of the minute weakly magnetic particles from the slurry flow. Also useful as matrix elements are ferromagnetic expanded metal lathing, filings, turnings and meshes.

The slurry is passed through the container at a rate sufficient to prevent sedimentation yet slow enough to enable the collection and retention of weakly magnetic particles from the flow onto the matrix elements. At the same time, the matrix is subjected to a high intensity field directed axially therethrough, in the same general direction as the overall flow of the slurry, between the pole members covering the ends of the container.

The magnetic field should have an intensity of at least 7,000 gauss within the matrix for the achievement of a separation of practical value in the brightening of slurried kaolin. An average, or mean, magnetic field intensity of at least 7,000 gauss should be maintained in the matrix throughout the distance between the confronting faces of the poll members for attainment of the full separating capability of the matrix. For the most effective separation the intensity should have a mean value of 8,500 gauss or higher, such as may be produced by maintaining a field strength in the range of 10,000 to 12,000 gauss or higher, or even as high as 20,000 gauss, at the faces of the pole members. It appears, however, that as the field strength is increased more and more above the value at which the matrix is in a state of magnetic saturation, a level is reached beyond which any increased effectiveness of the separation of the weakly susceptible particles of the slurry ceases to be attractive from an economic standpoint.

After a certain period of such flow, the effluent slurry will show an objectionably diminished extent of removal of the weakly magnetic particles. At this point, the slurry flow is discontinued and residual slurry may be rinsed out of the container, while still subjecting the matrix to the magnetic field, by flowing water through it sufficiently gently to leave collected particles on the magnetized matrix elements. Then the magnetizing of the matrix is discontinued and the collected particles are flushed from the container by a stronger flow of water therethrough. The several effluents from the container are collected separately.

Once a desired program is defined for a given set of operating conditions, the operating cycle can be repeated continuously under the control of a system which activates and times the flows of slurry, rinse water and flush water, and delivers the resulting effluents, in proper correlation with successive periods of magnetization of the collection matrix in the container.

BRIEF DESCRIPTION OF DRAWINGS

A preferred embodiment of the invention is diagrammatically illustrated, by way of example, in the accompanying drawings, in which.

DESCRIPTION OF PREFERRED EMBODIMENTS

Figure 1:
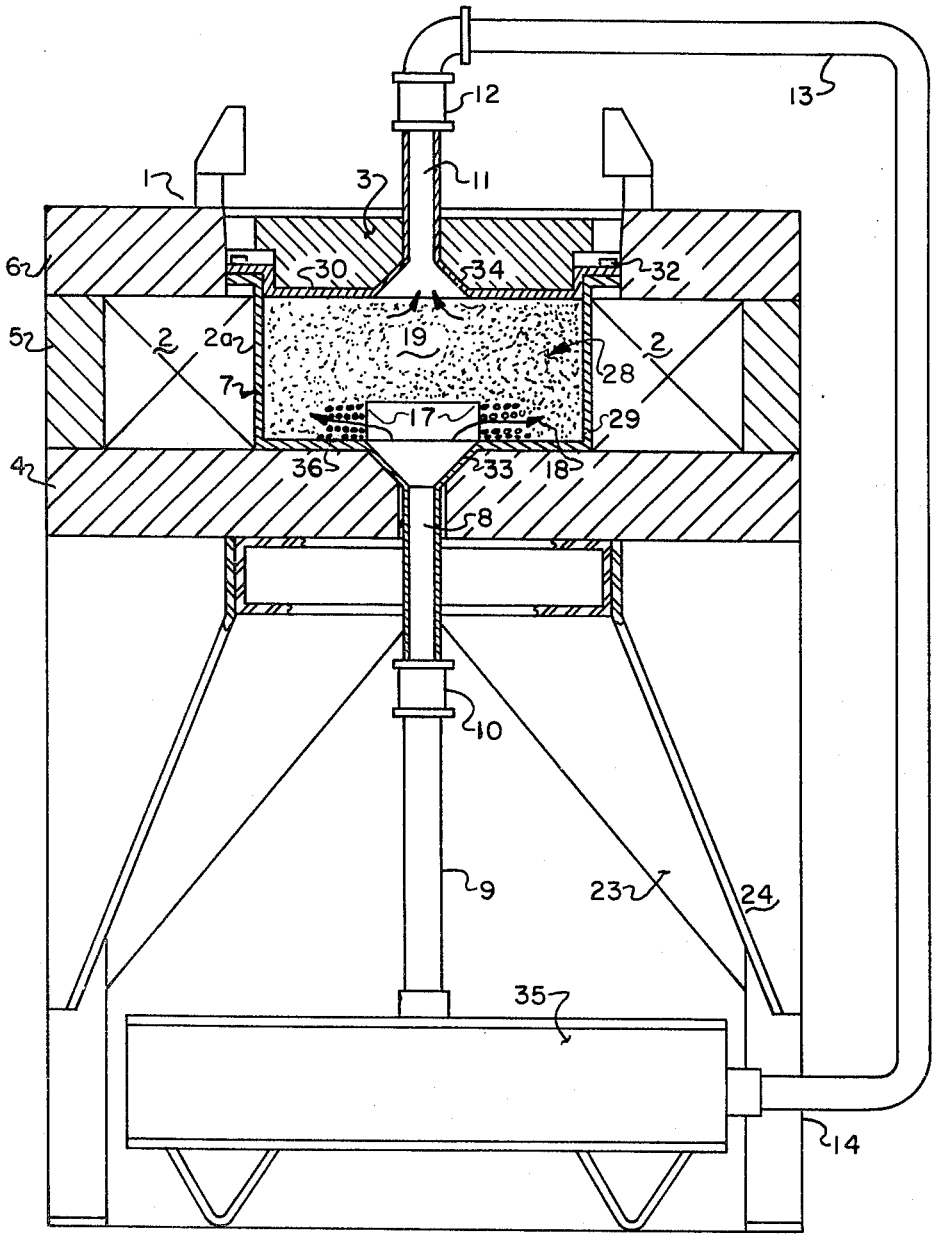
FIG. 1 is a longitudinal cross-section through a magnetic separator generally in accordance with the present invention.

The apparatus shown in FIG. 1, generally designated at 1, includes support legs 14 secured to members 23 and 24, which members in turn support the bulk of the separator. The magnetic field for the separator is preferably produced by means of an electromagnet, the coil for which is designated at 2. In order to provide the high field strengths required in accordance with the invention, coil 2 is adapted for high power dissipation—e.g., of the order of 300 KW at 3,000 amperes D.C.—and will typically comprise a hollow copper conductor, means being present (but not explicitly shown in the drawing) for pumping water or other coolant through the coil under pressure.

The magnetic circuit for apparatus 1 includes a series of cylindrical sections 3, 4, 5 and 6, all made of a ferromagnetic material such as steel, which sections substantially enclose coil 2 except for the inner side 2*a* thereof facing the longitudinal axis of the separator. Sections 3–6 and 4 constitute oppositely acting pole members. Section 3 and the central portion of section 4 define between them inside the coil 2 a magnetizing space 28 wherein a substantially vertically directed magnetic field is produced for effecting the described separation treatment of slurries in a matrix container disposed in this space. In a typical configuration, where coil 2 possesses electrical characteristics as specified above, space 28, which is cylindrical in form, may have an approximate height of about 20 inches and approximate diameter of 32 inches. A field of the order of 20,000 gauss is sustainable near the pole members with these indicated parameters. Lower field intensitites such as hereinabove described can, of course, be maintained in space 28 by suitable adjustment of coil current, and higher intensity fields can similarly be attained within the electrical operating limits of the coil, attendant power supplies, etc. In any event, the magnetic field in the matrix between the pole members is to be maintained at an average or mean intensity of at least 7,000 gauss, and preferably at a considerably higher strength as above pointed out, throughout the container matrix in which separation is effected.

A container 7, termed a canister, or optionally a plurality of canisters of smaller diameter, is disposed within space 28 after having been packed with elongate ferromagnetic elements constituting the matrix 19 within which actual separation is effected. The canister 7, in general, comprises a hollow cylindrical container 29 which may, for example, have a volume typically on the order of 70 gallons, and having a cover 30 fitted on the top thereof and secured thereto by bolts 32 extending through adjacent flanges formed on container and cover. A feed inlet tube 8 extends from a funnel-like portion 33 formed in the bottom of container 29 to a coupler 10 whereat a connection is made to tube 9 and thus to flow control system 35. A similar funnel-like portion 34 is formed in cover 30, with a product outlet tube 11 extending therefrom to coupler 12 whereat connection is made to tube 13 and thence back into the flow control system. It may be noted that upon disconnection of couplers 10 and 12 and removal of section 3, canister 7 may itself be readily removed from apparatus 1, whereby servicing thereof is readily enabled. The walls and cover of the canister 7 itself may be made of any of a variety of non-magnetic materials, for example, of a stainless steel or of a tough plastic material such as a PVC plastic or the like. Preferably the aspect ratio, which is the ratio of the diameter to the height, of the canister 7 in the magnetizing space of the separator is not less than 0.4 and may typically be 1.5, 1.8 or even 2.0 or greater. The determination of the desired aspect ratio is, of course, a matter of balancing the hydrodynamic difficulties of larger diameters with the economic advantages and efficiency of larger diameters and limited height from a magnetic standpoint.

Closely packed throughout canister 7 is a matrix 19 comprising a mass of myriad elongate ferromagnetic elements presenting surface irregularities, and each contacting yet also spaced from others so as to constitute a flux conductive collecting matrix of the nature specified in the general description. In the illustrated embodiment, the matrix is a mass of fine self-supporting filamentary material such as a steel wool compacted in and filling the space in the container. Uses of steel wool in magnetic separators are shown in U.S. Pat. Nos. 2,329,893 and 2,786,047. An especially advantageous collecting matrix may be obtained by use of a so-called "fine" or "medium" grade of commercially available No. 430 stainless steel wool. Because the steel wool is possessed of myriad strands having innumerable bends or turns and other surface irregularities, a vast number of collection points is provided by localized concentrations of the magnetic flux when the matrix is magnetized as herein described, and the field direction and gradients at such points vary enormously. The steel wool matrix, moreover, provides a relatively great amount of open space which, however, is so extensively interspersed by and between the wool that the slurry traversing the canister 7 is diverted into and through multitudinous flow courses having extremely narrow widths between the bordering magnetized strands of the wool. Accordingly, a relatively large volume of minute magnetic particles can be collected onto the strands before the flow of the slurry need be discontinued for flushing of the collected particles out of the canister.

For maximum efficiency a steel wool matrix is compacted in the container to a maximum extent consistent with allowing the desired flow of slurried kaolin particles through the matrix without objectionable stoppages or clogging of the matrix. It has been found effective to use compressed fine stainless steel wool, the strands of which occupy from 2 to 30% of the volume of the canister space.

While the steel wool or other matrix is above described as being placed in a canister 7 for convenience, it should be recognized that if the magnetizing space 28 is enclosed by suitable walls, a removable canister need not be used and the collection matrix may be placed directly in the magnetizing space 28.

The manner of carrying out an efficient separation of weakly magnetic minute particles from a slurry containing them in low concentration with substantially non-magnetic minute particles, such as for the removal of coloring impurities from a kaolin clay, may now be readily comprehended.

A clay-water slurry containing impurities of low magnetic susceptibility is prepared with a solids concentration of about 10 to 40%. With the canister disposed in the space between the pole members 3 and 4 and being subjected to the vertically directed magnetic field between them, the slurry is flowed into the canister 7 at one end thereof and thence through the matrix 19 and out of the other end of the canister, preferably being pumped upwardly through tube 8 into canister 7 so as to produce a counter flow to the heavier clay particles influenced by gravity. Flow rates are selected at a value at least sufficiently low so that the magnetized matrix within the canister 7 will collect the impurities from the moving slurry.

As the slurry enters the canister 7, it follows the flaring walls of port 33. It may initially be passed through a pebble bed 36 to provide a more uniform flow distribution for the slurry. Alternatively, a cone structure such as shown at 20 in FIG. 2 or a plurality of such structures may be employed to produce the desired flow distribution. The flow of the slurry thereafter meanders tortuously through the matrix 19 although, if desired, additional flow control means may be optionally employed to produce specific flow patterns. A typical incremental path or course of the slurry flow is indicated schematically at 18. It should be observed that while net flow is indeed in the vertical direction of the magnetic field, substantial flow of the slurry also takes place in random directions including directions transverse to the field direction. The consequence of such diverse courses of flow and of the concentration of flux patterns at myriad locations in and along them is that magnetic forces are brought to bear in diverse relationships to the incremental directions of flow and to the orientations of particles in the slurry, and thus the likelihood of capturing a given magnetic particle is much augmented.

Figure 2:
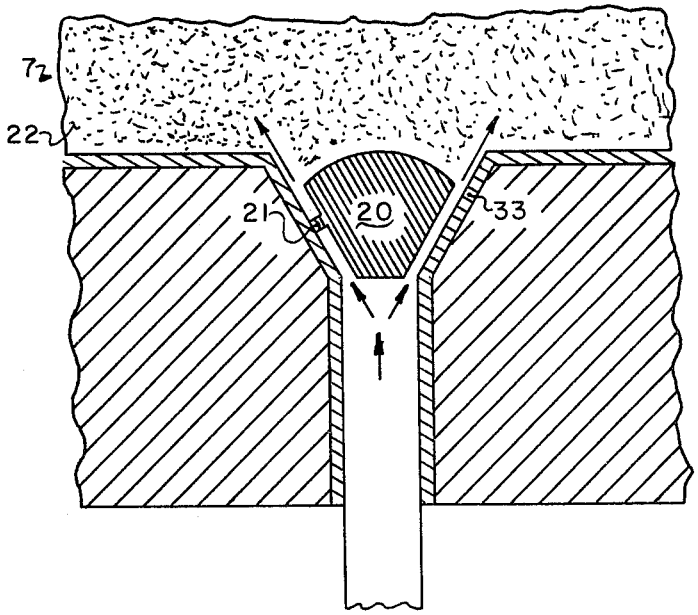
FIG. 2 is a partial, longitudinal sectional view of a structure useful as a portion of the apparatus.

In FIG. 2, a variant construction for the ports leading to and from the canister 7 is partially depicted. In this construction a conical steel cone plug 20 is present in each funnel-like port 33 or 34, said plug 20 being supported in spaced relationship from the outer conical wall of port 33 or 34 by ridges such as that at 21. The said plugs 20 constitute segments of the pole members, and they directly contact a mass of steel wool 22 contained in the canister so as to provide a pathway for conducting magnetic flux into the matrix. In addition to thereby lowering magnetic reluctance in the field, the steel plugs 20 serve to distribute the flow in the canister 7 to thereby establish flow patterns such as are described in connection with FIG. 1. The flow pattern may be further altered and controlled by the use of a plurality of cone plugs 20 at each end of a canister.

Cone plugs 20 may be constructed of solid steel or similar ferromagnetic material or may be formed from a suitable array of steel wool, metallic screens and meshes or the like.

Figure 3:
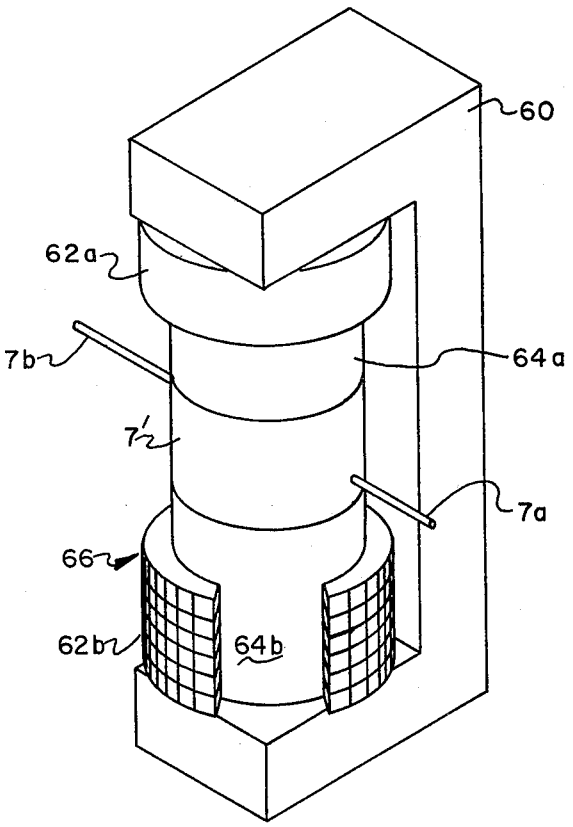
FIG. 3 is a schematic obilque projection, partly in section, of another embodiment of a magnetic separator in accordance with the present invention.

Another embodiment of a magnetic separator in accord with the present invention is shown in FIG. 3. In this embodiment the separator includes a U-, C-, or yoke-shaped supporting means and ferromagnetic flux conductive return frame 60 having vertically disposed opposing pole members **64*a* and 64*b* which constitute cores of a high intensity eletromagnet indicated generally at 66. The electromagnet in this embodiment comprises like coils 62***a* and 62*b* surrounding and supported on the spaced apart magnet poles. The electromagnet 66 is of course provided with suitable, conventional electrical controls and circuits (not shown in FIG. 3) and may be provided with cooling water and similar conventional features of high intensity electromagnets. The even confronting surfaces of the poles 64*a*, 64b are so spaced apart as to receive and cover the ends of a ferromagnetic collection matrix container 7′, similar to canister 7, described above. The collection matrix within container 7′, composed of multitudinous elongate ferromagnetic elements as described above, is subjected to the magnetic field produced by energization of the coils 62*a*, 62*b* of electromagnet 66 while the container 7′ is in working position in the gap between the faces of the pole members 64*a*, 64*b*. The slurry enters container 7′ through inlet port 7*a* and proceeds to flow tortuously through the container, being diverted into multitidinous diverse courses by the structure of the collection matrix, while the flux of the magnetic field generated by the energized electromagnet 66 is applied in generally axial direction between the faces of the pole members and at myriad locations within the matrix has locally induced fields resulting therein. The treated slurry exits from the container at outlet 7*b*. The substantially axial magnetic field applied is one of high intensity as above described having an average intensity of at least 7,000 gauss in the matrix from end to end of container 7′ between the pole members 64*a*, 64*b*. The desired conditions of the flow of the slurry are as described above.

After the predetermined period of slurry flow through the matrix, during which time the magnetically more susceptible components of the slurry are being collected on the matrix, the slurry flow is discontinued and the residual slurry is then rinsed out of container 7′, while still subjecting the matrix to the magnetic field, by flowing water through the container sufficiently gently to leave the collected particles on the magnetized matrix elements. Following the completion of this rinsing cycle, the energization of coils 62*a*, 62*b* and electromagnet 66 is discontinued and the collected particles are flushed from the container 7′ by a stronger flow of water therethrough. The several effluents from the container are collected separately and obtained in a manner such as described hereinafter with specific reference to the embodiment shown in FIG. 1.

In typical operation of the apparatus of the present invention as described with specific reference to the embodiment shown in FIG. 1, but equally applicable in all substantial principles to the embodiment of FIG. 3, flow of the slurry to be treated is effected upwardly through canister 7 for a period of time with the electromagnet activated thereby effecting collection of magnetics. During this period the effluent slurry of non-magnetics (product) is led off by tube 13 to a suitable receptacle. After a sufficient volume of magnetics has collected, as may be indicated by observation of a substantial diminution of the extent of purification of the effluent slurry, a two stage flow of water through canister 7 may be initiated. An initial low velocity flow is used, with the matrix still being subjected to the magnetic field, to displace residual slurry entrapped or enclosed within the canister and wash some adhering non-magnetic particles from the collected magnetic particles. A so-called "middlings" effluent is thus obtained, which may be collected and reprocessed if desired. Thereafter, the magnetizing of the matrix is discontinued, as by cutting off the current to coil 2, and a high velocity water flow is used to flush retained magnetic particles out of the canister. Detergent-laden water may be employed if desired to assist in the flushing operation.

A flow system, positioned as at 35 in FIG. 1, may be utilized in accordance with the invention to carry out in a completely automatic and pre-programmed manner the operations set forth in the preceding paragraph. A system appropriate to this function is depicted in a schematic fashion in FIG. 4. As seen therein the system 40 generally includes a series of electrically activated valves which in response to control signals emanating from system control 41 open or close for predetermined periods to divert and/or direct flow to or from the canister 7. System control 41 includes timing cams and switches to effect activation of the various valves, and is also connected via a lead 42 to magnet coil 2, whereby off-on control of the magnetic field is enabled.

During the initial phase of slurry feed, slurry by-pass valve 43 (normally open) is energized so that slurry feed through line 46 is diverted entirely to feed/drain diverter valve 44. The latter is also energized whereby flow is through ports A-B thereof, thence into line 9 and to the bottom inlet of canister 7. Flow out of the canister is via line 11 which connects to the energized valve 47 (normally closed) and thereby to a non-magnetics collection point. Coil 2 of the electromagnet is also activated during this period which typically extends in time for the order of 15 minutes.

During the second phase of the operative cycle, low pressure washing of the canister contents is carried out. With coil 2 still activated, this is effected by inactivating valve 47 and admitting rinse water through low pressure rinse water valve 48, thence via throttle valve 49, line 50 and check valve 51, into tube 11. The exiting rinse water from canister 7 then passes via line 9 and ports A–C of de-energized valve 44 to de-energized valve 45 and via ports A–C of de-energized valve 44 to de-energized valve 45 and via ports A–B to the middlings drain. This "rinse" phase of the operative cycle will typically continue for the order of 2 minutes. While the rinse water as shown and described flows opposite the slurry flow, it may and, indeed, is often preferred to flow in the same direction as the slurry flow to minimize any inadvertent removal of collected magnetic particles.

Figure 4:
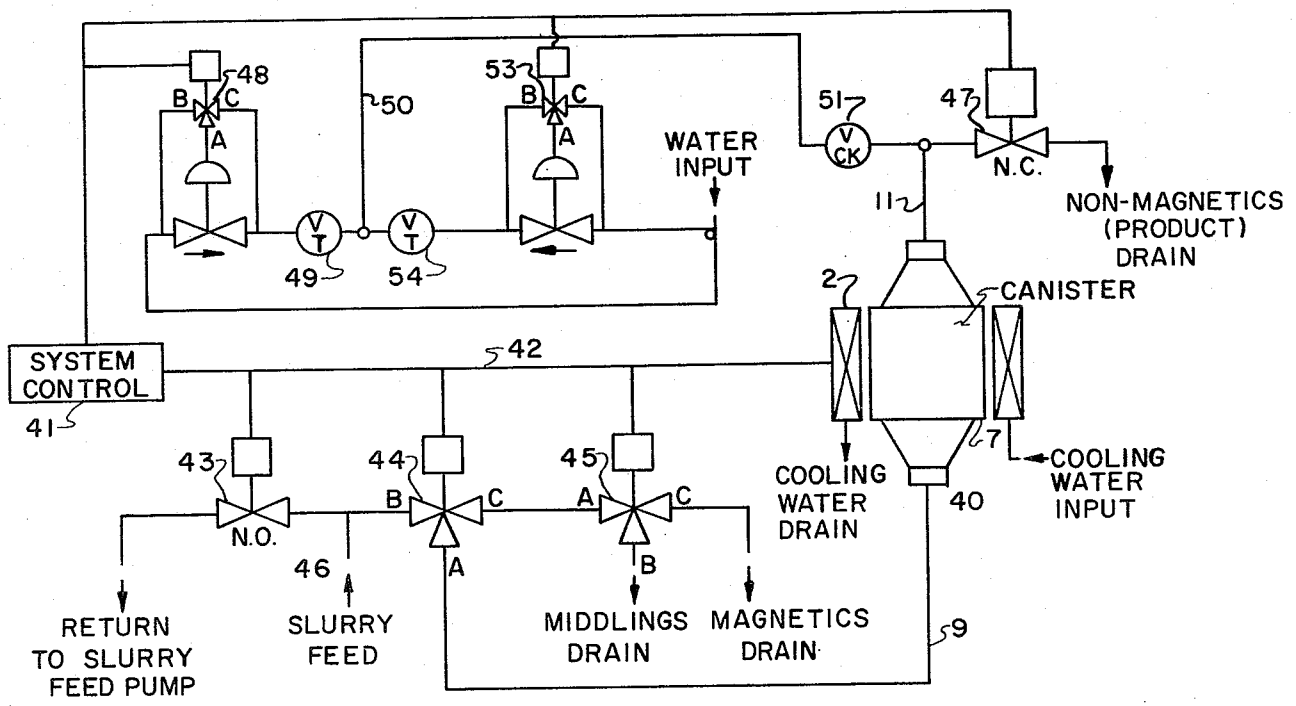
FIG. 4 is a simplified schematic flow diagram, illustrating a flow control system utilized to effect the feed, rinse, and flush portions of an operating cycle in slurry treatment according to the invention.

During the final—"flush"—phase of the operative cycle, coil 2 is inactivated and a high velocity flow of water is established. In FIG. 4, this flow is in the same direction through canister 7 as is utilized for the "rinse" flow phase, but it may well be in the opposite direction. The positioning of the various valve elements is in accord with the description rendered for the rinse phase, except that high velocity flow is admitted into line 50 via the energized pressure regulating valve 53 and throttle valve 54, and valve 45 is now de-energized whereby flow is via ports A–C thereof and to the magnetics drain point.

In a typical operation processing kaolin clays, it is preferred to operate on a cyclic pattern in which clay is fed in slurry form to the magnetic separator for from 5 to 30 minutes. The feeding of kaolin slurry to the separator is then interrupted and the canister and matrix then rinsed with low velocity water for a period of time on the order of ½ to 5 minutes to displace the clay slurry left in the magnetized matrix while not contaminating the kaolin slurry with the magnetics that have been collected. The magnet is then de-energized and the matrix is flushed with high velocity water for approximately 1 to 10 minutes to discharge the collected magnetic particles. Typically, for a separator such as that of FIG. 1, the complete rinse and flush cycle may take approximately 5 minutes.

Numerous advantages of the present invention are readily apparent. The system of the present invention allows the use of high intensity magnetic fields acting on a continuously programmed high volume of slurry the retention time of which may be varied over a wide range. The high intensity magnetic field produced, while macroscopically homogeneous, induces high field gradients at a multiplicity of points and edges of the elements of a matrix which produces a tortuous flow that meanders in courses extending both lengthwise and transverse to the applied magnetic field. The flow distribution may be further modified by the use of conical flow distribution plugs, baffles, pebble beds and the like to produce the desired flow pattern. For example, the use of one or more conical flow distributors serves to force the inflow toward the outer circumferential areas of the matrix thereby producing a longer path length of flow and engaging a higher volume of the collector surfaces. The utilization of one hundred percent of the open space of the matrix within the field for slurry treatment during up to 75% of the total operating time results in high throughputs and efficiency. The matrix elements are typically capable of holding in excess of 25% or in some cases even up to 100% or more of their weight in attracted magnetic particles, which are readily removed when desired by the use of the pressure flush cycle. While capable of operating with high throughputs, the present system operates with low fluid pressure gradients and low drag forces on the submicron particles of the slurry. The system utilizing electromagnetically magnetized pole members can produce the desired results without the use of any moving parts other than the external control valves, thus making it easy to maintain in operation on a commercial basis.

While the present invention has been particularly described in terms of specific embodiments thereof, it will be understood in view of the present disclosure that numerous variations are now enabled to those skilled in the art, within the scope of the instant teaching.

What is claimed is:

1. In a method for brightening clay by removing therefrom weakly magnetically susceptible impurities at least one of iron and titanium mineral contaminants by dispersing the clay in an aqueous medium to form a slurry, passing the slurry through a magnetic separator having ferromagnetic pole members and having a magnetic field of at least 7,000 gauss to remove at least one of said mineral contaminants, the improvement comprising:

(a) forming said slurry as about a 10–40% solids by weight;

(b) disposing a container upright in the magnetic separator between the said ferromagnetic pole members which are spaced apart in a vertical direction with the opposite ends of the container adjacent to and covered by confronting surfaces of said pole members, the container being filled with multitudinous elongate ferromagnetic matrix elements presenting surface irregularities and packed in the container space with each contacting yet also spaced from others so as to constitute a flux conductive matrix that will divert liquid flow into and concentrate flux at myriad points bounding diverse courses of minute width within the container, said matrix elements being selected from the group consisting of corrugated and non-corrugated stainless steel strips, ribbons, or wires, woven steel wire, ribbons, or steel wool, ferromagnetic metal lathing, filings, turnings and meshes; wherein said matrix elements have the capacity of holding in excess of 25% up to 100% of their weight in attracted magnetic particles;

(c) establishing in said matrix between the said pole members a substantially vertically directed magnetic field through said matrix of an average strength of at least 7,000 gauss;

(d) while continuing to subject said matrix to said magnetic field, flowing said slurry continuously into one end of said container and then through said matrix in a generally vertical direction and delivering treated slurry from the other end of said container at a rate sufficient to prevent sedimentation in said container yet such that a substantial portion of said weakly magnetically susceptible impurities are collected and retained on said ferromagnetic matrix elements, the rate of flow of said slurry being such that it has a retention time in said matrix of from one half to eight minutes;

(e) discontinuing said flow when the extent of removal of said impurities from the slurry flow has substantially diminished;

(f) then while subjecting said matrix to said field, flowing water through said container to rinse out the residual slurry by using a sufficiently gentle flow of water to leave collected particles of impurities on said magnetized elements;

(g) then discontinuing the magnetizing of said matrix and flowing water through said container at an increased velocity sufficient to flush the collected particles out of said container; and (h) collecting the rinse effluent and the flush effluent from said container separately from the effluent treated slurry and separately from each other.

2. A method according to claim 1, wherein the matrix element is steel wool and the strands of the steel wool occupy from about 2 to 30% of the volume of the container space.

3. A method according to claim 1, wherein the clay slurry is fed through said magnetic separator for from 5 to 30 minutes, the feeding of the slurry is then interrupted and the container and matrix are rinsed with low velocity water for a period of time of one half to five minutes to displace the clay slurry left in the magnetized matrix while not contaminating the clay slurry with the magnetics that have been collected, the magnet is then de-energized and the matrix is flushed with high velocity water for approximately 1 to 10 minutes to discharge the collected magnetic particles, and then the magnets are again energized and the clay slurry flow is then resumed.

* * * * *